US006604742B2

(12) United States Patent
El Sabbagh

(10) Patent No.: US 6,604,742 B2
(45) Date of Patent: Aug. 12, 2003

(54) CATCHING GAME

(76) Inventor: Jimmy El Sabbagh, 420 Mills St., Apartment 39, Leesburg, FL (US) 34748

( * ) Notice: Subject to any disclaimer, the term of this patent is extended or adjusted under 35 U.S.C. 154(b) by 0 days.

(21) Appl. No.: 09/871,940

(22) Filed: Jun. 4, 2001

(65) Prior Publication Data

US 2002/0180154 A1 Dec. 5, 2002

(51) Int. Cl.[7] ..... A63B 67/06

(52) U.S. Cl. ..... 273/348.4; 446/46; 446/47; 473/570; 473/573

(58) Field of Search ..... 273/348.4; 473/570, 473/573; 446/46–48

(56) References Cited

U.S. PATENT DOCUMENTS 3,545,760 A * 12/1970 Wilson ..... 273/DIG. 17
3,941,383 A * 3/1976 Clarke ..... 273/348.4
3,953,030 A 4/1976 Muchnick
3,999,748 A 12/1976 Clarke
4,049,271 A * 9/1977 Fonti ..... 273/348.4
4,335,536 A * 6/1982 Magid et al. ..... 446/224
4,718,677 A 1/1988 Barnes
4,735,420 A 4/1988 Seidler
4,736,955 A 4/1988 Pollock
4,869,699 A * 9/1989 Plambeck et al. ..... 446/46
5,067,727 A * 11/1991 Crompton ..... 273/336
5,209,490 A * 5/1993 Dallavecchia ..... 273/348.4
5,240,257 A * 8/1993 Sassak ..... 273/348.2
5,297,799 A * 3/1994 Slater et al. ..... 273/412
5,316,311 A * 5/1994 Lee ..... 273/348.4
5,362,066 A * 11/1994 Sassak ..... 273/348
5,362,067 A * 11/1994 Nelson ..... 273/317

* cited by examiner

*Primary Examiner*—Mark S. Graham
(74) *Attorney, Agent, or Firm*—Richard C. Litman

(57) ABSTRACT

A throw and catch game or sport whereby a plastic disk is thrown by one player and caught by the other player wearing a glove or pad. The disk and the glove have complementary strips of VELCRO on their outer surfaces. The catcher merely touches the flying disk, allowing it to adhere to the target glove. The disk is a plastic, arc-shaped device with a foam padding or air pocket at the bottom center portion. VELCRO covers the foam padding/air pocket at the top center, and the plastic disk below the bottom center and the outer edge. The pocket may also contain a battery operated light. The pocket may also include an electronic recorder (programmed or random) and an electronic sound/music player, which may be activated by spinning the disk, as when it is thrown or activated by other means as desired.

14 Claims, 8 Drawing Sheets

CATCHING GAME

BACKGROUND OF THE INVENTION

1. Field of the Invention

The present invention relates to a game or sport. More particularly, the invention is a throw and catch game whereby a plastic disk is thrown by one player and the other player wearing a glove or a pad with straps contrives to catch the disk.

2. Description of the Related Art

The use of lightweight plastic disks having a rounded outer edge or lip for a tossing and catching game or sport is well known. The configuration when spinning is relatively stable and may sail for a substantial distance when properly thrown. The disks are generally referred to as FRISBEE's. They are not easily caught by people or youngsters with limited agility and dexterity. It would be desirable to provide a disk throw and catch game where the disk is more easily caught.

U.S. Pat. No. 3,953,030, issued Apr. 27, 1976, to Muchnick describes a throw and catch game that includes a glove having a palm surface upon which are disposed a plurality of strips of one component of VELCRO. The other component of VELCRO is disposed on the surface of a ball. The glove is used by one player to catch the ball when thrown by another player.

U.S. Pat. No. 4,735,420, issued Apr. 4, 1988, to Seidler, describes a catching disk and a ball covered with a mutually complementary fibre coating and burr material, so that the ball striking the catching disk is retained.

U.S. Pat. No. 3,999,748, issued Dec. 28, 1976, to Clarke describes a children's game of catch in which a ball covered with burr material is used in conjunction with a mitt or glove having an outer surface covered with a material to which the ball adheres. The ball is formed of two identical wheel elements.

U.S. Pat. No. 4,718,677, issued Jan. 12, 1988 to Barnes describes a throw and catch game in which a projectile covered with VELCRO is thrown by one player to be caught by another player whose knees and elbows are covered with a complementary VELCRO portion.

U.S. Pat. No. 4,736,955, issued Apr. 12, 1988, to Pollock describes a pitch and toss game employing disks of various configurations having contact engaging material such as VELCRO on one side and a target for receiving the disks located on the ground at a distance. Points are scored or the game proceeds according to where the disk lands on the target.

None of the above inventions and patents, taken either singularly or in combination, is seen to describe the instant invention as claimed. Thus, a disk throwing and catching game solving the aforementioned problems is desired.

SUMMARY OF THE INVENTION

The present invention is a throw and catch game or sport whereby a plastic disk is thrown by one player and the other player wearing a glove or a pad with engaging straps contrives to catch the disk. The disk and the glove have complementary strips of VELCRO strategically disposed on their outer surfaces. In this way, the catcher of the disk is provided with several new innovative possibilities to catch the disk, allowing the disk to adhere to the target glove, with a minimized effort on the part of the catcher.

The disk is a plastic, arc-shaped device with a foam padding, or air, pocket attached underneath the center portion. The hook and loop material, or VELCRO(preferably the loop component) covers the generally flat upper center partition of the disk, and the flexible plastic pocket below the upper center portion of the disk and the outer depending lip. The catching glove or pad preferably is covered with the hook component of VELCRO.

The pocket may also contain a battery operated light. The pocket may also include an electronic recorder (programmed or random) which may be activated by spinning the disk, as when it is thrown or activated by other means as desired. The pocket may also include an electronic sound/music player box (programmed or random) which may also be activated by spinning the disk, or by other means. The recorder and the sound/music box may both be included in the pocket.

Accordingly, it is a principal object of the invention to provide a throw and catch game or sport where a spinning disk is employed which is easily caught.

It is another object of the invention to provide a game as above where the spinning disk is easily caught by providing complementary portions of VELCRO to the disk and catching device.

It is a further object of the invention to provide a game as above where the catching device is a hand worn glove or pad.

Still another object of the invention is to provide a game as above where the disk forms a centrally located pocket having a VELCRO covering, the pocket containing air or a foam or foam rubber material.

Yet another object of the invention is to provide a game as above wherein the pocket contains a sound recording device and/or a sound/music box which are activated upon spinning the disk.

Still another object of the invention is to provide a game as above wherein the pocket contains a battery operated light.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a throw and catch game or sport whereby a plastic disk is thrown by one player and the other player wearing a glove or a pad with engaging straps contrives to catch the disk. The disk and the glove have complementary strips of VELCRO (mutually engaging hook and loop material) strategically disposed on their outer surfaces. In this way, the catcher of the disk is provided with several new innovative possibilities to catch the disk allowing the disk to adhere to the target glove with a minimized effort on the part of the catcher.

The disk is a plastic, arc-shaped device with a foam padding, or air (empty), attached pocket underneath the center portion. The hook and loop material, or VELCRO (preferably the loop component), covers the generally flat upper center portion of the disk, and the flexible plastic pocket below the upper center portion of the disk and the outer depending lip. The pocket may also contain a battery operated light. The pocket may also include an electronic recorder (programmed or random) which may be activated by spinning the disk, as when it is thrown or activated by other means as desired. The pocket may also include an electronic sound/music player box(programmed or random) which may also be activated by spinning the disk, or other means. The recorder and the sound/music box may both be included in the pocket.

Figure 1:
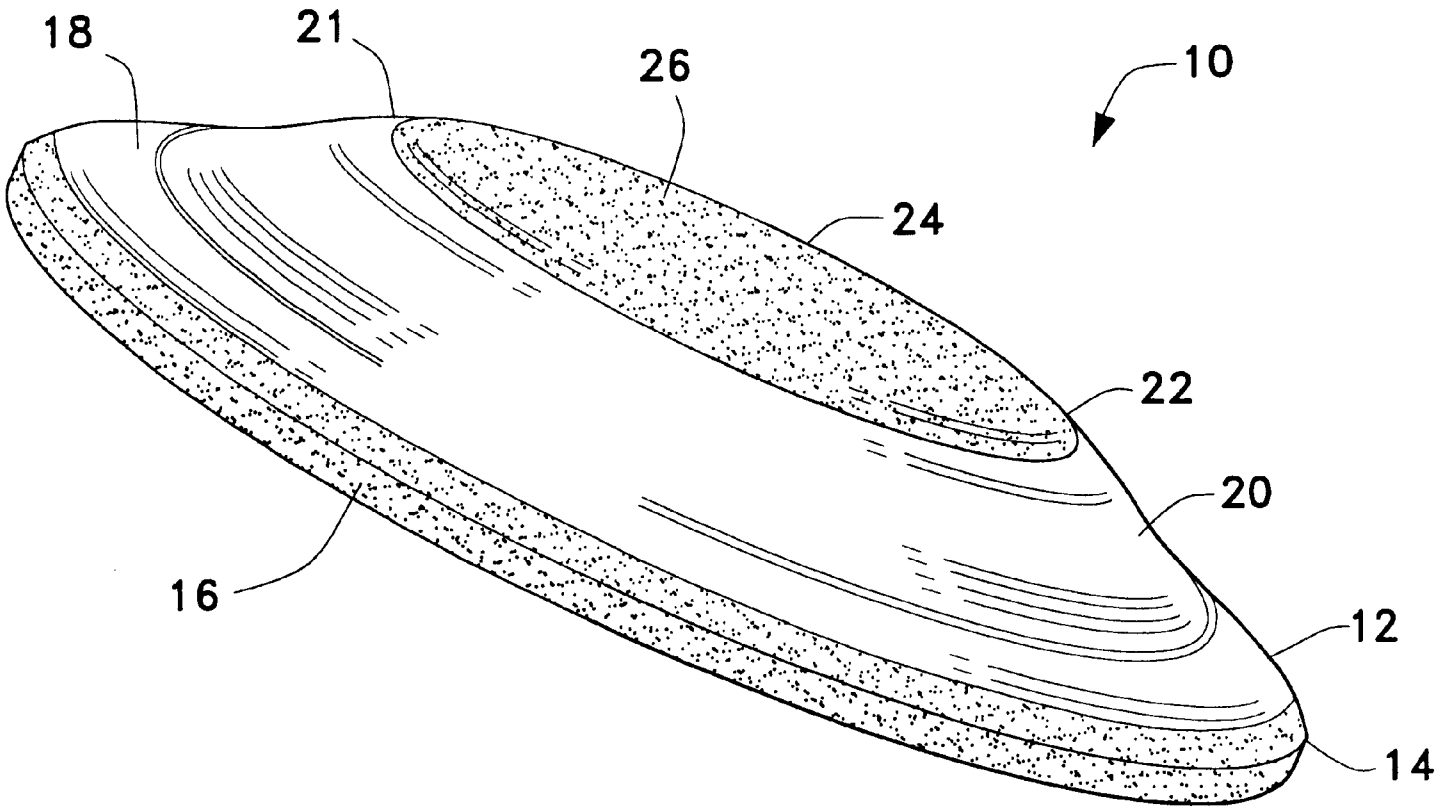
FIG. 1 is a perspective view of the inventive disk of the present invention.
Figure 2:
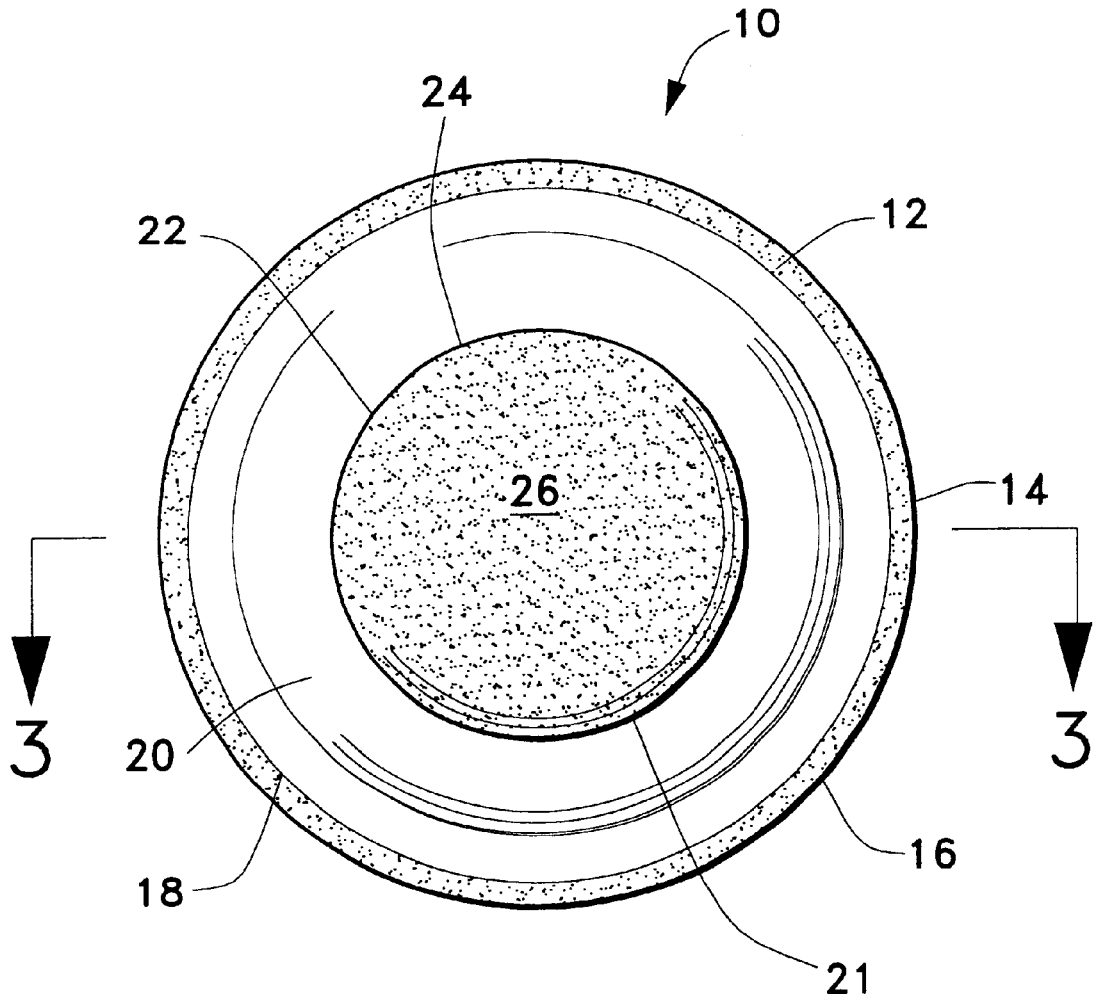
FIG. 2 is a plan view of the inventive disk of FIG. 1.
Figure 3:
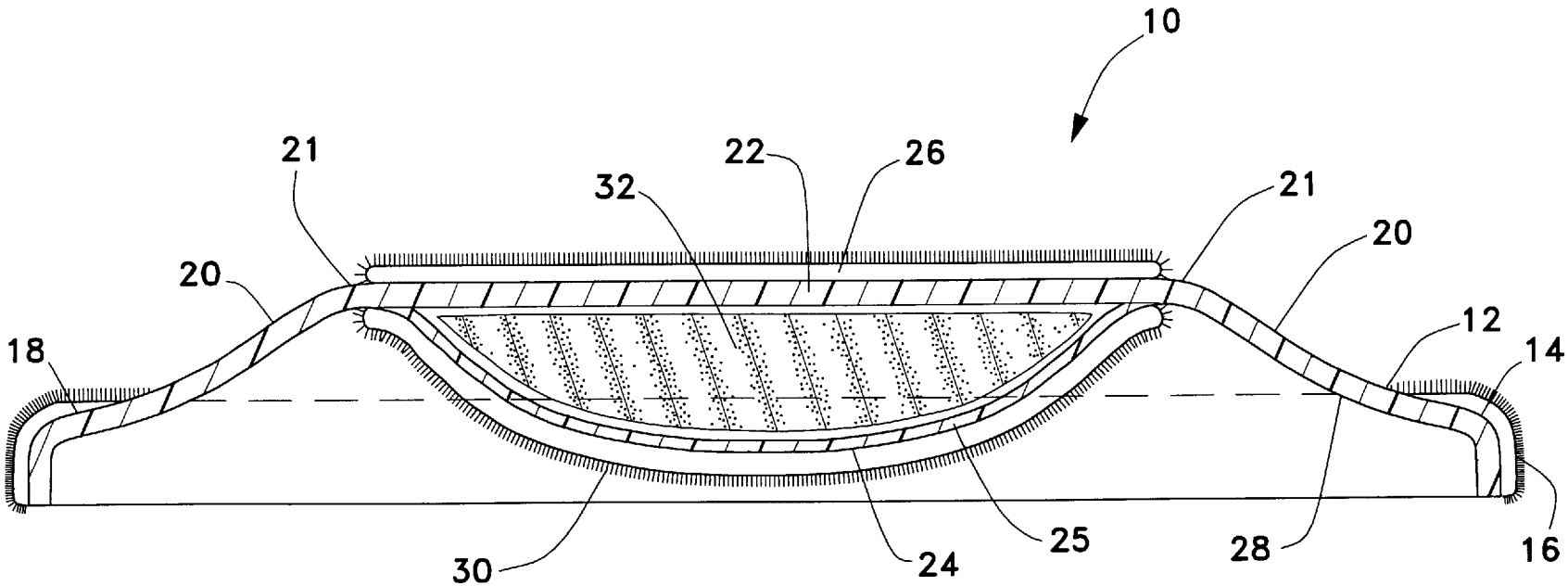
FIG. 3 is a sectional view of the inventive disk drawn along lines 3—3 of FIG. 2.

Referring to FIGS. 1–3, there are shown a perspective view, a plan view and a sectional view, respectively, of the inventive disk of the throw and catch game system 10. Disk 12 is generally arcuate and features outer edge or lip 14 covered with loop material 16 and depending from disk outer portion 18. Disk rise portion 20 rises from outer portion 18 toward the center of the disk 12. Disk rise portion 20 leads to inner lip 21 which defines a generally flat disk center portion 22. Disk pocket 24, formed by flexible plastic, generally hemispherical wall 25, is joined with and depends from inner lip 21. Disk center portion 22 is covered by pocket loop material cover 26 and extends inward from inner lip 21. Disk lower surface 28 generally conforms with the arcuate disk 12. Loop material 30 covers the lower surface area of disk pocket 24. Pocket foam cushion 32 is contained within disk pocket 24.

Figure 4A:
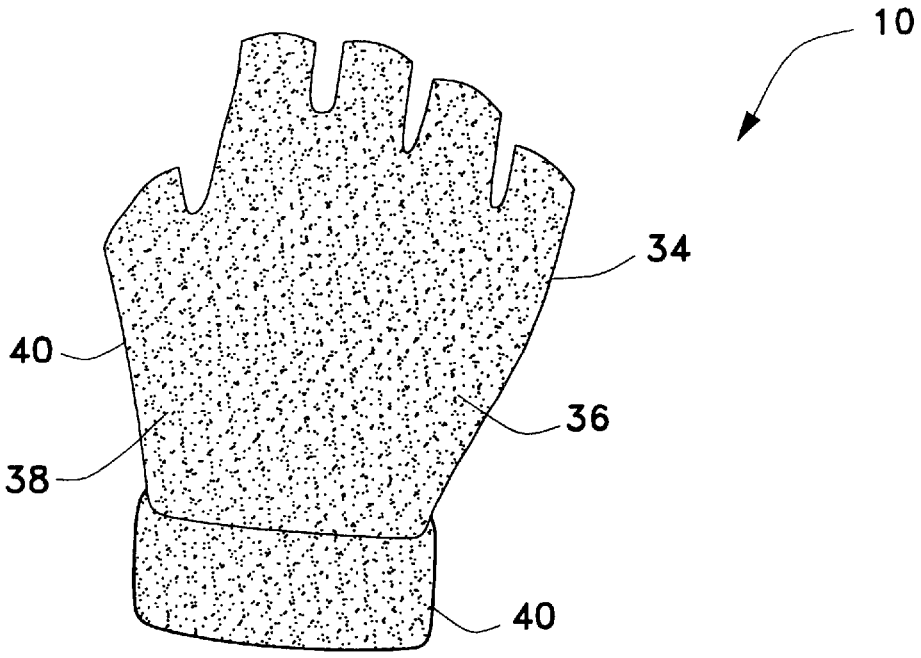
FIG. 4A is a top view of the disk catching glove of the present invention.
Figure 4B:
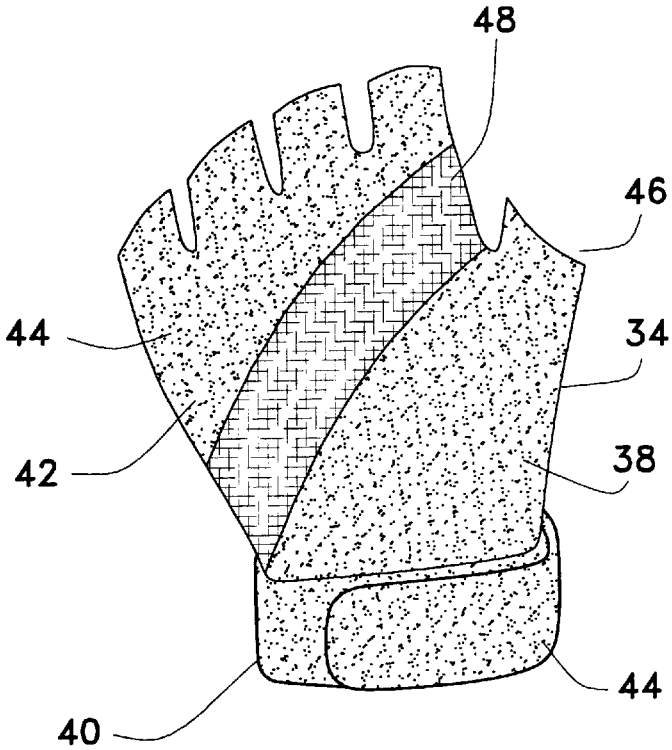
FIG. 4B is a bottom view of the disk catching glove of FIG. 4A.

Referring to FIGS. 4A and 4B, there are shown catching glove 34 of throw and catch game system 10. Catching glove 34 includes a top portion 36 covered with hook material 38 and features adjustable wrist portion 40. Catching glove 34 also includes a bottom portion 42 (see FIG. 4B) and includes finger portion 44 and thumb portion 46, covered with hook material 38 separated by palm portion 48. Catching glove palm portion 48 is bare of hook material 38 to promote gripping action of the wearer's hand. Finger portion 44 and thumb portion 46 extends to the first knuckle and are open at the finger and thumb ends to provide more variety of fit and to cool the hand during use.

Figure 5A:
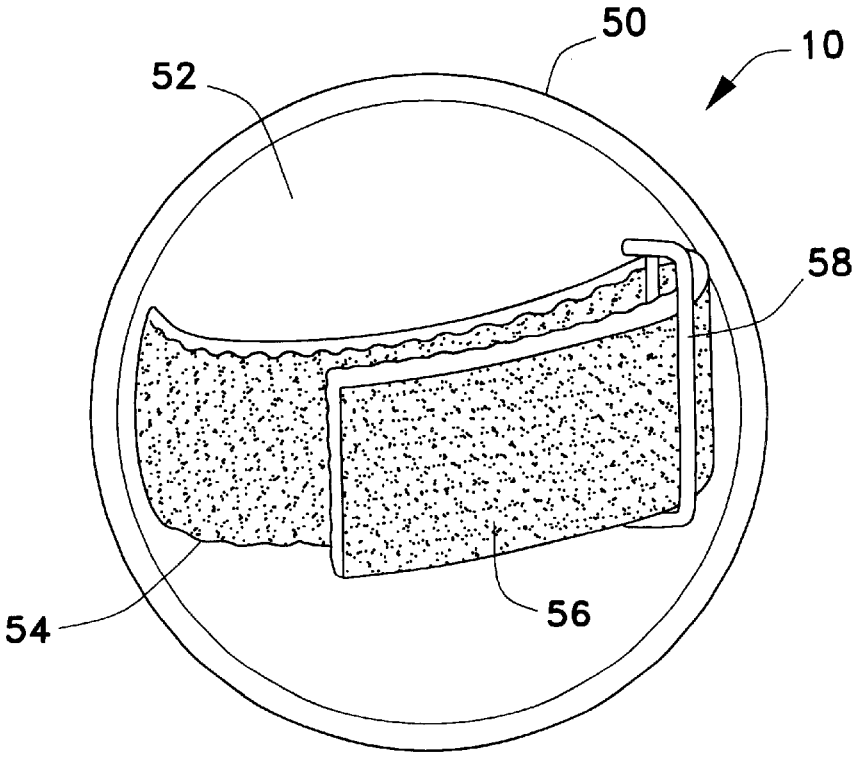
FIG. 5A is a top view of the disk catching pad of the present invention.
Figure 5B:
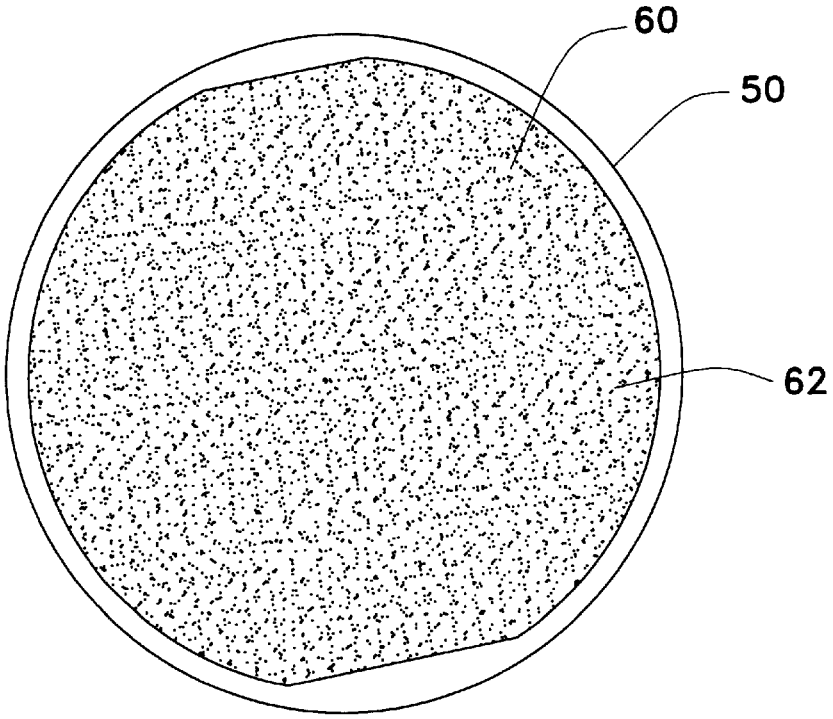
FIG. 5B is a bottom view of the disk catching pad of FIG. 5B.

Referring to FIGS. 5A and 5B, there is shown a top view and a bottom view, respectively of catching pad 50, an alternative to catching glove 34 in throw and catch game system 10. Catching pad 50 includes back portion 52 having wrist engaging hand loop 54 mounted thereon. Hand loop 54 includes loop strap 56 and loop strap buckle 58, the size of hand loop 54 being adjustable by tightening loop strap 56 with loop strap buckle 58 so as to fit the user. Catching pad 50 further includes bottom side 60 having catching pad hook material strips 62 located thereon to assist in catching arcuate disk 12.

Figure 6:
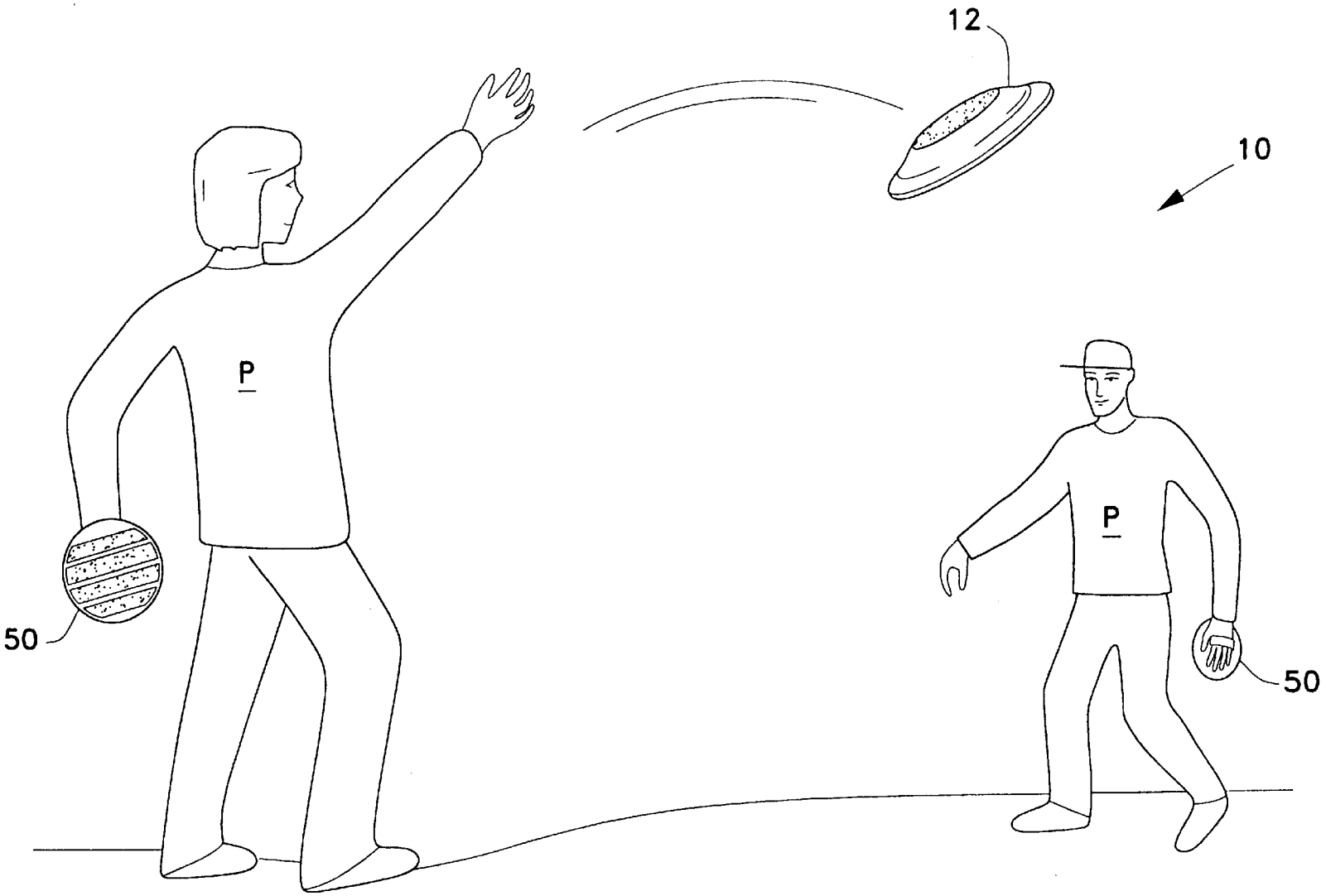
FIG. 6 is an environmental view of the disk and pads of the present invention in use.

Referring to FIG. 6, there is shown an environmental view of the throw and catch game 10 wherein players P alternately throw and catch arcuate disk 12. The players wear catching pads 50 for catching the disk 12.

Figure 7:
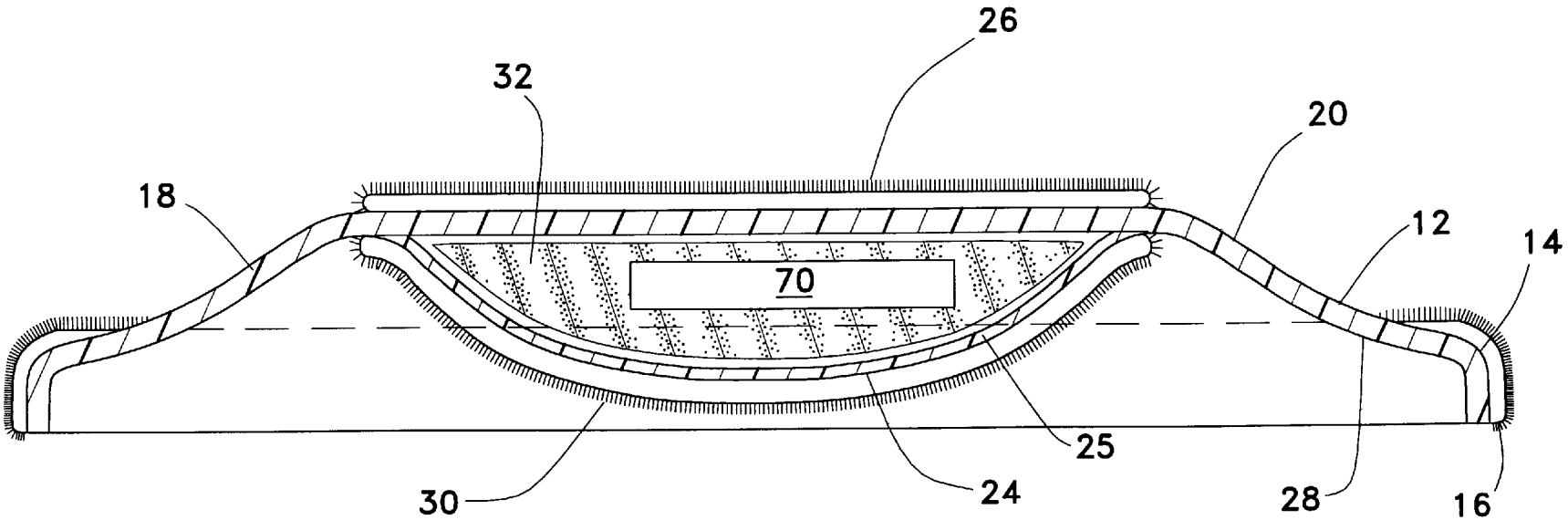
FIG. 7 is a plan view as in FIG. 2 illustrating the mounting of a spin actuated sound recorder and/or a sound/music box.

Referring to FIG. 7, there is shown a sectional view of the arcuate disk 12, similar to that of FIG. 2. Pocket recorder and/or sound/music box 70 is located within pocket 24, formed by flexible plastic, generally hemispherical wall 25, and may be held in a void in foam cushion 32, as shown, or otherwise mounted on a bracket (not shown) with pocket 24 devoid of foam. The recorder and/or sound/music box may be programmed or random and activated by a centrifugal force actuated switch which activates upon imparting spin to the arcuate disk 12, or may otherwise be activated in any manner as desired. Devices of this type are well known and the details are not given herein.

Figure 8:
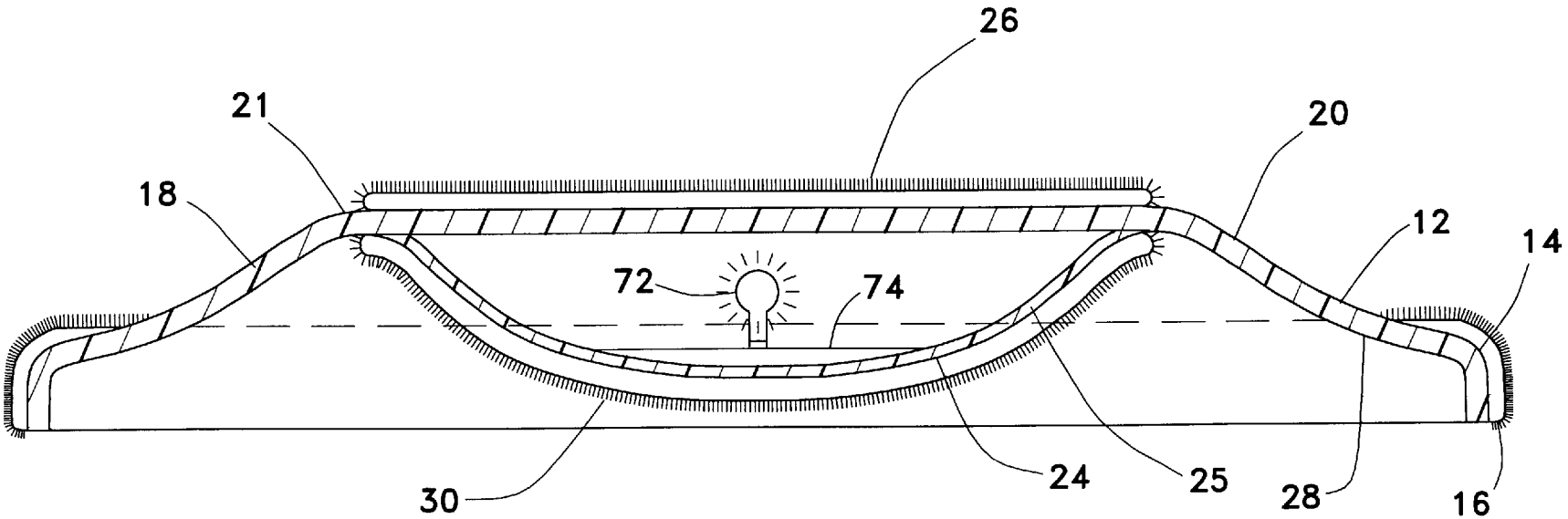
FIG. 8 is a plan view as in FIG. 2 illustrating the mounting of a battery operated light.

Referring to FIG. 8, there is shown a sectional view of the arcuate disk 12, similar to that of FIG. 2. Battery operated light 72 is mounted on mount 74 within pocket 24, formed by flexible plastic, generally hemispherical wall 25 of arcuate disk 12 (battery is not shown). In this embodiment the pocket is devoid of foam, and the arcuate disk 12 is a translucent or transparent material, preferably plastic so the light may be seen during use in darkness.

The details and dimensions of the present invention may vary, such as size and specific configuration. The preferred size of the arcuate disk is about 10 inches in diameter with a height of about 1¼ inches. The pocket is about 5 inches in diameter at its rim and about 1¼ inches in maximum depth. The size of the pocket may vary as desired. The pocket may be filled with air, only, or foam as described. Catching gloves or pads may vary in size for different ages and hand sizes.

The arcuate disk may be partially or totally covered by VELCRO (mutually engaging hook and loop material). Alternatively, the disk may bear no VELCRO, in which case the VELCRO covered gloves or pads are not necessary. The hook portions and the loop portions of the VELCRO may be interchanged between the pads or gloves and the disk.

Differing VELCRO types and sizes may be employed in the invention, and varying VELCRO portions design and distribution on the arcuate disk and the gloves or pads is contemplated by the invention. The foam pads for the disk pocket may vary in foam type and density. The material for the disk is preferably plastic, but may be of any desired material such as metal. The glove or pad may be made of any convenient material such as plastic or leather. The pad may be rigid or flexible.

It is to be understood that the present invention is not limited to the embodiments described above, but encompasses any and all embodiments within the scope of the following claims.

I claim:

1. A throw and catch game for first and second players comprising:

a generally arcuate disk having an upper outer surface and a lower inner surface forming:
- a depending lip portion;
- a disk rise portion inward of said lip portion;
- an inner lip inward of said disk rise portion; and
- a generally flat center portion surrounded by said inner lip;

a closed disk pocket attached to said lower inner surface of said disk at said inner lip;

said disk pocket being flexible and generally hemispheric;

means for catching said arcuate disk by a receiving game player;

loop material located along the outer surface of said depending lip portion of said arcuate disk and upon exposed portions of said hemispheric pocket; and hook material located upon portions of said catching means;

whereby, upon said first player throwing said arcuate disk in a manner to induce spin, said second player receives said arcuate disk by engaging said loop material on said arcuate disk or said disk pocket with said hook material on said catching means.

2. The throw and catch game of claim 1, wherein said catching means is a glove having said hook material located on its exterior.

3. The throw and catch game of claim 2, wherein said glove has a top side and a bottom side and said hook material is located on both said top side and said bottom side.

4. The throw and catch game of claim 1, wherein said catching means is a generally circular pad having a first side and a second side and having hook material located on at least said first side of said pad and a strap for engaging the wrist of said receiving player located on said second side.

5. The throw and catch game of claim 1, wherein said generally arcuate disk has loop material located on said generally flat center portion upper surface.

6. The throw and catch game of claim 5, wherein said hemispheric pocket has a generally upper inner surface and a generally lower outer exposed surface.

7. The throw and catch game of claim 6, wherein said generally lower outer exposed surface of said hemispheric pocket has loop material located thereon.

8. The throw and catch game of claim 7, wherein said loop material covers said outer exposed surface of said pocket.

9. The throw and catch game of claim 8, wherein said pocket contains a pad of foam material.

10. The throw and catch game of claim 8, further comprising a recorder mounted within said closed pocket.

11. The throw and catch game of claim 10, further comprising a centrifugally actuated switch for actuating said recorder upon spin being imparted to said generally arcuate disk.

12. The throw and catch game of claim 8, further comprising a sound or music box mounted within said closed pocket.

13. The throw and catch game of claim 12, further comprising a centrifugally actuated switch for actuating said recorder upon spin being imparted to said generally arcuate disk.

14. The throw and catch game of claim 8, further comprising a battery operated light mounted within said closed pocket.

* * * * *